US010750774B2

(12) United States Patent
Fujisawa et al.

(10) Patent No.: US 10,750,774 B2
(45) Date of Patent: Aug. 25, 2020

(54) EXTRACTION METHOD OF FLAVOR CONSTITUENT AND MANUFACTURING METHOD OF COMPOSITION ELEMENT OF FAVORITE ITEM

(71) Applicant: JAPAN TOBACCO INC., Tokyo (JP)

(72) Inventors: Yoshinori Fujisawa, Tokyo (JP); Takuma Nakano, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 198 days.

(21) Appl. No.: 15/246,753

(22) Filed: Aug. 25, 2016

(65) Prior Publication Data

US 2016/0360779 A1 Dec. 15, 2016

Related U.S. Application Data

(63) Continuation of application No. PCT/JP2015/055209, filed on Feb. 24, 2015.

(30) Foreign Application Priority Data

Feb. 26, 2014 (JP) ..... 2014-035438

(51) Int. Cl.
*A24B 15/24* (2006.01)
*A24B 15/26* (2006.01)
*A24B 15/28* (2006.01)

(52) U.S. Cl.
CPC ..... *A24B 15/24* (2013.01); *A24B 15/243* (2013.01); *A24B 15/245* (2013.01); *A24B 15/26* (2013.01); *A24B 15/287* (2013.01)

(58) Field of Classification Search
None
See application file for complete search history.

(56) References Cited

U.S. PATENT DOCUMENTS 1,538,265 A 5/1925 Arnold
2,822,306 A 2/1958 Thienemann et al.
(Continued)

FOREIGN PATENT DOCUMENTS

CN 1050540 A 4/1991
CN 103589514 A 2/2014
(Continued)

OTHER PUBLICATIONS

First Office Action dated Jun. 9, 2017, in Chinese Patent Application No. 201480076381.X, with English translation.
Extended European Search Report dated Aug. 25, 2017, in European Patent Application No. 15755597.0
Extended European Search Report dated Oct. 4, 2017, in European Patent Application No. 15755206.8.
Extended European Search Report dated Sep. 14, 2017, in European Patent Application No. 14883799.0.
(Continued)

*Primary Examiner* — Michael J Felton
*Assistant Examiner* — Katherine A Will
(74) *Attorney, Agent, or Firm* — Birch, Stewart, Kolasch & Birch LLP

(57) ABSTRACT

An extraction method of a flavor constituent comprises: a step A for heating a tobacco raw material which is subjected to an alkali treatment; and a step B for bringing a release component released in the gas phase in the step A into contact with a collection solvent at normal temperature until any time from when a first condition is satisfied to when a second condition is satisfied. The first condition is determined based on a residual rate of nicotine component. The second condition is determined based on a remaining amount of nicotine component.

6 Claims, 7 Drawing Sheets

(56) References Cited

U.S. PATENT DOCUMENTS

| | | | | |
|---|---|---|---|---|
| 4,244,381 | A | 1/1981 | Lendvay | |
| 4,941,484 | A | 7/1990 | Clapp et al. | |
| 5,005,593 | A | 4/1991 | Fagg | |
| 5,018,540 | A * | 5/1991 | Grubbs | A24B 15/24 131/297 |
| 5,038,802 | A | 8/1991 | White et al. | |
| 5,065,775 | A | 11/1991 | Fagg | |
| 5,121,757 | A | 6/1992 | White et al. | |
| 5,235,992 | A | 8/1993 | Sensabaugh, Jr. | |
| 5,311,886 | A | 5/1994 | De Grandpre et al. | |
| 5,377,698 | A | 1/1995 | Litzinger et al. | |
| 5,435,325 | A | 7/1995 | Clapp et al. | |
| 5,445,169 | A | 8/1995 | Brinkley et al. | |
| 5,533,530 | A | 7/1996 | Young et al. | |
| 6,109,272 | A | 8/2000 | Saito et al. | |
| 6,298,859 | B1 | 10/2001 | Kierulff et al. | |
| 2007/0023058 | A1 | 2/2007 | Howell et al. | |
| 2007/0137665 | A1 | 6/2007 | Torikai et al. | |
| 2007/0193596 | A1 | 8/2007 | Mori et al. | |
| 2011/0155152 | A1 | 6/2011 | Harris et al. | |
| 2012/0006345 | A1 | 1/2012 | Yajima et al. | |

FOREIGN PATENT DOCUMENTS

| | | | |
|---|---|---|---|
| EP | 1 782 702 | A1 | 5/2007 |
| EP | 1 915 064 | A2 | 4/2008 |
| JP | 54-52798 | A | 4/1979 |
| JP | 1-235571 | A | 9/1989 |
| JP | 2-49572 | A | 2/1990 |
| JP | 2-238873 | A | 9/1990 |
| JP | 3-10667 | A | 1/1991 |
| JP | 5-7485 | A | 1/1993 |
| JP | 8-98672 | A | 4/1996 |
| JP | 8-504598 | A | 5/1996 |
| JP | 9-9947 | A | 1/1997 |
| JP | 2872408 | B2 | 1/1999 |
| JP | 11-113552 | A | 4/1999 |
| JP | 2002-520005 | A | 7/2002 |
| JP | 2003-516723 | A | 5/2003 |
| JP | 2006-180715 | A | 7/2006 |
| JP | 2009-502160 | A | 1/2009 |
| JP | 2009-261314 | A | 11/2009 |
| JP | 2011-522558 | A | 8/2011 |
| JP | 2013-507104 | A | 3/2013 |
| WO | WO 01/28367 | A1 | 4/2001 |
| WO | WO 2005/122803 | A1 | 12/2005 |
| WO | WO 2006/022198 | A1 | 3/2006 |
| WO | WO 2006/046517 | A1 | 5/2006 |
| WO | WO 2007/052159 | A2 | 5/2007 |
| WO | WO 2007/052159 | A3 | 5/2007 |
| WO | WO 2007/053097 | A1 | 5/2007 |
| WO | WO 2009/150444 | A1 | 12/2009 |
| WO | WO 2010/110227 | A1 | 9/2010 |
| WO | WO 2011/042166 | A1 | 4/2011 |
| WO | WO 2013/146952 | A1 | 10/2013 |

OTHER PUBLICATIONS

Notification of Reasons for Refusal dated Sep. 12, 2017, in Japanese Patent Application No. 2016-555187, with English translation.
Official Action dated Sep. 29, 2017, in Russian Patent Application No. 2016137908, with English translation.
Second Office Action dated Jan. 12, 2018, in Chinese Patent Application No. 201480076381.X, with English translation.
U.S. Office Action issued in U.S. Appl. No. 15/247,166 dated Oct. 29, 2018.
International Search Report, issued in PCT/JP2015/055209, dated May 19, 2015.
Written Opinion of the International Searching Authority, issued in PCT/JP2015/055209, dated May 19, 2015.
U.S. Office Action, dated Sep. 27, 2018, in Copending U.S. Appl. No. 15/247,208.
Notification of Examination Result dated Jan. 9, 2017, in Taiwan Patent Application No. 104134843, with English translation.
Notification of Reason(s) for Refusal dated Feb. 7, 2017, in Japanese Patent Application No. 2016-504994, with English translation.
Database WPI, Week 199211, Thomson Scientific, London, GB; AN 1992-080599, XP002781325 & CN 1 050 540 A (Feng Shixing) Apr. 10, 1991, abstract.
Database WPI, Week 201427, Thomson Scientific, London, GB; AN 2014-G75248 XP002781324 & CN 103 589 514 A (Shanghai Tocacco Group Co., Ltd.), Feb. 19, 2014, abstract.
Extended European Search Report dated Jun. 5, 2018, in European Patent Application No. 15852051.0.
U.S. Appl. No. 15/493,400, filed Apr. 21, 2017.
Canadian Office Action for corresponding Canadian Application No. 2,940,612, dated Oct. 13, 2017.
Canadian Office Action for corresponding Canadian Application No. 2,940,680, dated Oct. 12, 2017.
Canadian Office Action for corresponding Canadian Application No. 2,940,690, dated Oct. 13, 2017.
Chinese Office Action for corresponding Chinese Application No. 201580010569.9, dated Jun. 2, 2017, with English translation.
Chinese Office Action for corresponding Chinese Application No. 201580010590.9, dated Jun. 2, 2017, with English translation.
International Search Report for International Application No. PCT/JP2014/078410, dated Feb. 3, 2015.
International Search Report for International Application No. PCT/JP2015/055208, dated May 19, 2015.
International Search Report for International Application No. PCT/JP2015/079053, dated Dec. 28, 2015.
Korean Office Action for corresponding Korean Application No. 10-2016-7022737, dated Oct. 30, 2017, with English translation.
Korean Office Action for corresponding Korean Application No. 10-2016-7022739, dated Oct. 30, 2017, with English translation.
U.S. Office Action for U.S. Appl. No. 15/493,400, dated Feb. 25, 2019.
U.S. Office Action for U.S. Appl. No. 15/493,400, dated Jul. 12, 2018.
U.S. Office Action for U.S. Appl. No. 15/493,400, dated May 22, 2019.

* cited by examiner

| SAMPLE | TYPE | Nic. AMOUNT [wt%-DB] |
|---|---|---|
| A | BURLEY TYPE | 4.9 |
| B | BURLEY TYPE | 2.2 |
| C | FLUE CURED TYPE | 4.2 |

EXTRACTION METHOD OF FLAVOR CONSTITUENT AND MANUFACTURING METHOD OF COMPOSITION ELEMENT OF FAVORITE ITEM

CROSS REFERENCE TO RELATED APPLICATIONS

This application is a Continuation of PCT International Application No. PCT/JP2015/055209, filed on Feb. 24, 2015, which claims priority under 35 U.S.C. 119(a) to Patent Application No. 2014-035438, filed in Japan on Feb. 26, 2014, all of which are hereby expressly incorporated by reference into the present application.

TECHNICAL FIELD

The present invention relates to an extraction method of flavor constituent and a producing method of a composition of a favorite item.

BACKGROUND ART

A technique has been conventionally proposed, in which a flavor constituent (e.g. alkaloid including a nicotine component) contributing to a tobacco flavor is extracted from a tobacco raw material and the extracted flavor constituent is supported on a base material for a flavor source.

As a technique related to a method for extracting a flavor constituent (hereinafter, a first prior art), for example, a method for removing a flavor constituent from a tobacco raw material by using ammonia gas is known (e.g. Patent Literature 1).

Alternatively, as a technique related to a method for extracting a flavor constituent (hereinafter, a second prior art), a supercritical extraction method by using an extraction solvent and a capture solvent is known (e.g. Patent Literature 2).

In the first prior art described above, it is required to apply pressure to ammonia gas. It is also required to separate a flavor constituent from ammonia gas, and a device for such separation is a large-scale device with a complicated mechanism. Therefore, capital investment costs are high and maintenance costs are also high.

In the second prior art described above, meanwhile, it is required to apply pressure to an extraction solvent, and a pressure container and a circulation pipe and the like are required, and a device for extracting a flavor constituent is a large-scale device as is the case with the first prior art. Therefore, capital investment costs are high and maintenance costs are also high.

CITATION LIST

Patent Literature

Patent Literature 1: JP S54-52798 A
Patent Literature 2: JP 2009-502160 A

SUMMARY

A first feature is summarized as an extraction method for extracting a flavor constituent from a tobacco raw material, comprising: a step A for heating a tobacco raw material which is subjected to an alkali treatment; and a step B for bringing a release component released in the gas phase in the step A into contact with a collection solvent at normal temperature until any time from when a first condition is satisfied to when a second condition is satisfied, wherein the first condition is a condition that a remaining amount of nicotine component which is an index of the flavor constituent contained in the tobacco raw material decreases until reaching 1.7 wt % in the case where the weight of the tobacco raw material in the dry state is 100 wt %, or is a condition that a residual rate of the nicotine component decreases until 40% in the case where the weight of the tobacco raw material is 100 wt %, and the second condition is a condition that the remaining amount of the nicotine component contained in the tobacco raw material decreases until reaching 0.3 wt % in the case where the weight of the tobacco raw material in the dry state is 100 wt %.

A second feature is summarized as the extraction method according to the first feature, wherein the second condition is a condition that the remaining amount of the nicotine component contained in the tobacco raw material decreases until reaching 0.4 wt % in the case where the weight of the tobacco raw material in the dry state is 100 wt %.

A third feature is summarized as the extraction method according to the first feature, wherein the second condition is a condition that the remaining amount of the nicotine component contained in the tobacco raw material decreases until reaching 0.6 wt % in the case where the weight of the tobacco raw material in the dry state is 100 wt %.

A fourth feature is summarized as the extraction method according to the first feature, wherein the second condition is a condition that the remaining amount of the nicotine component contained in the tobacco raw material decreases until reaching 0.7 wt % in the case where the weight of the tobacco raw material in the dry state is 100 wt %.

A fifth feature is summarized as the extraction method according to any one of the first feature to the fourth feature, wherein the tobacco raw material is subjected to a water addition treatment in the step A.

A sixth feature is summarized as the extraction method according to any one of the first feature to the fifth feature, wherein the temperature of the collection solvent is 10° C. or more and 40° C. or less.

A seventh feature is summarized as a manufacturing method of a composition of a favorite item, comprising: a step A for heating a tobacco raw material which is subjected to an alkali treatment; a step B for bringing a release component released in the gas phase in the step A into contact with a collection solvent at normal temperature until any time from when a first condition is satisfied to when a second condition is satisfied; and a step C for adding the collection solution to the component, wherein the first condition is a condition that a remaining amount of nicotine component which is an index of the flavor constituent contained in the tobacco raw material decreases until reaching 1.7 wt % in the case where the weight of the tobacco raw material in the dry state is 100 wt %, or is a condition that the residual rate of the nicotine component decreases until 40% in the case where the weight of the tobacco raw material is 100 wt %, and the second condition is a condition that the remaining amount of the nicotine component contained in the tobacco raw material decreases until reaching 0.3 wt % in the case where the weight of the tobacco raw material in the dry state is 100 wt %.

DESCRIPTION OF EMBODIMENTS

Figure 1:
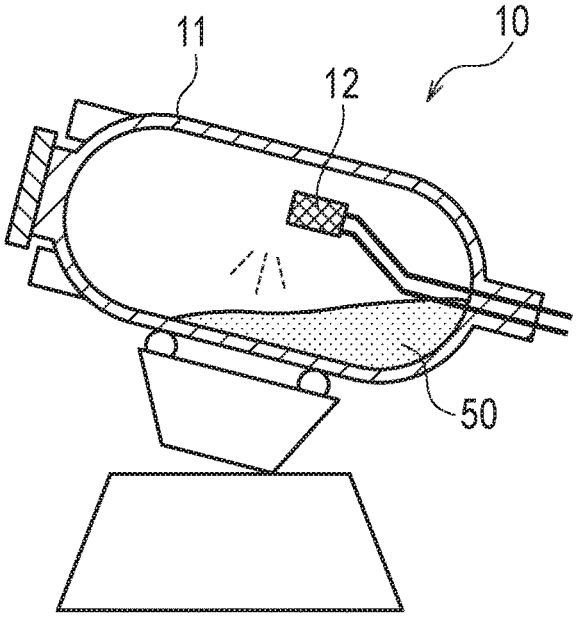
FIG. 1 is a diagram illustrating an example of the extraction device in the first embodiment.

Next, an embodiment will be described. Note that, the same or similar portions are denoted with the same or similar reference signs in the descriptions of the drawings below. Note that, the drawings are schematic and a ratio of each size is different from a real one.

Therefore, specific sizes and the like should be judged in consideration of the following descriptions. Needless to say, portions of which relationship and ratios of mutual sizes are different between the mutual drawings, are included.

Summary of Embodiments

The extraction method of flavor constituent according to the embodiments is a method for extracting a flavor constituent from a tobacco raw material. The extraction method comprises a step A for heating a tobacco raw material which is subjected to an alkali treatment, and a step B for bringing a release component released in the gas phase in the step A into contact with a collection solvent at normal temperature until any time from when a first condition is satisfied to when a second condition is satisfied. The first condition is a condition that a remaining amount of nicotine component which is an index of the flavor constituent contained in the tobacco raw material decreases until reaching 1.7 wt % in the case where the weight of the tobacco raw material in the dry state is 100 wt %, or is a condition that a residual rate of nicotine component decreases until 40% in the case where the weight of the tobacco raw material is 100 wt %. The second condition is a condition that a remaining amount of nicotine component contained in the tobacco raw material decreases until reaching 0.3 wt % in the case where the weight of the tobacco raw material in the dry state is 100 wt %.

In the embodiments, the step B for bringing a release component into contact with a collection solvent is continued at least until the first condition is satisfied. Therefore, the step B is continued in a zone in which the decrease rate of the remaining amount of smoking flavor constituent contained in a tobacco raw material (i.e. a rate at which a nicotine component is volatilized from the tobacco raw material) is not less than a predetermined rate, and thus the smoking flavor constituent can be efficiently recovered. In the meantime, the step B for bringing a release component into contact with a collection solvent is finished at least by the time when the second condition that the remaining amount of nicotine component contained in a tobacco raw material decreases until reaching 0.3 wt % is satisfied. Therefore, a situation in which although a rise in the recovery rate of flavor constituent (herein, a nicotine component) is not expected, the step B is continued is inhibited, and the flavor constituent can be efficiently extracted from a tobacco raw material.

As described above, a flavor constituent can be sufficiently extracted by simple treatments such as the step A and the step B. That is, a flavor constituent can be extracted by a simple device.

It should be noted that a nicotine component is an example of a flavor constituent contributing to a tobacco flavor and is used as an index of a flavor constituent in the embodiments.

First Embodiment (Extraction Device)

Figure 2:
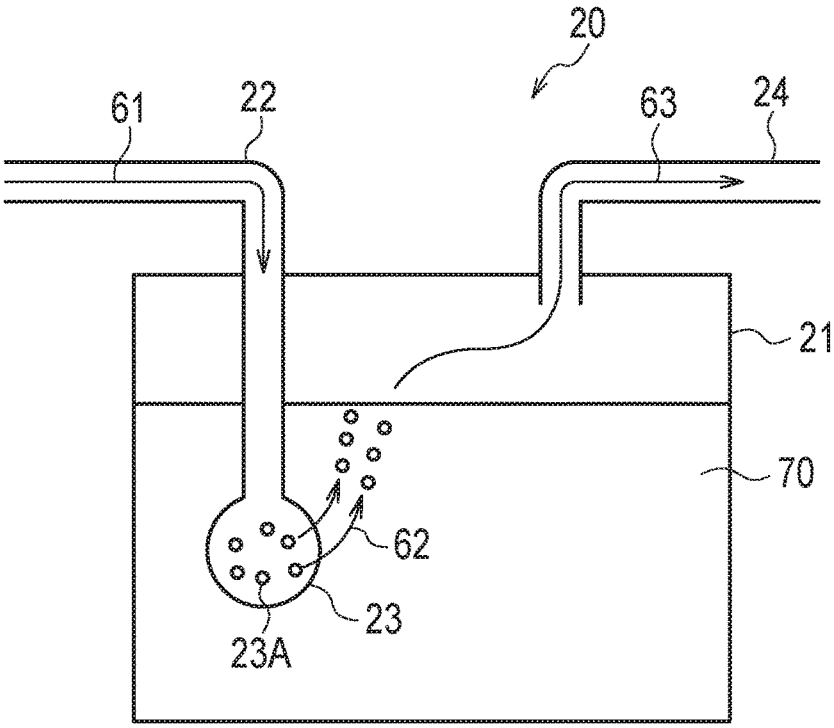
FIG. 2 is a diagram illustrating an example of the extraction device in the first embodiment.

The extraction device in the first embodiment will be described below. FIG. 1 and FIG. 2 are diagrams illustrating an example of the extraction device in the first embodiment.

First, an example of an alkali treatment device 10 will be described with reference to FIG. 1. The alkali treatment device 10 has a container 11 and a spray 12.

A tobacco raw material 50 is put in the container 11. The container 11 is constituted of for example members with heat resistance and pressure resistance (e.g. SUS; Steel Used Stainless). It is preferred that the container 11 constitute a sealed space. The "sealed space" is a state to prevent contamination by solid foreign substances in normal handling (e.g. transportation, storage). Therefore, the vaporization of a flavor constituent contained in the tobacco raw material 50 to the outside of the container 11 is inhibited.

The spray 12 provides an alkaline substance for the tobacco raw material 50. It is preferred that a basic substance such as an aqueous solution of potassium carbonate, for example, be used as an alkaline substance.

It is preferred that the spray 12 provide an alkaline substance for the tobacco raw material 50 until the pH of the tobacco raw material 50 becomes 8.0 or more. It is further preferred that the spray 12 provide an alkaline substance for the tobacco raw material 50 until the pH of the tobacco raw material 50 becomes in a range from 8.9 to 9.7. In order to efficiently release a flavor constituent in the gas phase from the tobacco raw material 50, the amount of water in the tobacco raw material 50 after spraying of an alkaline substance is preferably 10 wt % and further preferably 30 wt % or more. The upper limit of the amount of water in the tobacco raw material 50 is not particularly limited, and is for example preferably 50 wt % or less in order to efficiently heat the tobacco raw material 50.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

As the tobacco raw material 50, for example, *Nicotiana* raw materials such as *Nicotiana tabacum* and *Nicotiana rustica* can be used. As *Nicotiana tabacum*, for example, a variety such as Burley type or flue cured type can be used. As the tobacco raw material 50, a tobacco raw material of a type other than Burley type and flue cured type may be also used.

The tobacco raw material 50 may be constituted of a cut or powder tobacco raw material (hereinafter, also referred to as raw material pieces). In such case, the diameter of raw material pieces is preferably 0.5 mm to 1.18 mm. Such raw material pieces are obtained for example using a stainless sieve in accordance with JIS Z 8801 by screening in accordance with JIS Z 8815. For example, raw material pieces are screened using a stainless sieve with a 1.18 mm sieve opening by a dry and mechanical shaking method over 20 minutes to obtain raw material pieces which pass through a stainless sieve with a 1.18 mm sieve opening. Subsequently, the raw material pieces are screened using a stainless sieve with a 0.50 mm sieve opening by a dry and mechanical shaking method over 20 minutes to remove raw material pieces which pass through a stainless sieve with a 0.50 mm sieve opening. That is, the raw material pieces are raw material pieces which pass through a stainless sieve deciding the upper limit (sieve opening=1.18 mm) and do not pass through a stainless sieve deciding the lower limit (sieve opening=0.50 mm).

Second, an example of a collection device 20 will be described with reference to FIG. 2. The collection device 20 has a container 21, a pipe 22, a release section 23 and a pipe 24.

A collection solvent 70 is put in the container 21. The container 21 is constituted of for example a glass. It is preferred that the container 21 constitute a sealed space. The "sealed space" is a state to prevent contamination by solid foreign substances in normal handling (e.g. transportation, storage).

The temperature of the collection solvent 70 is for example normal temperature. The lower limit of normal temperature is for example a temperature at which the collection solvent 70 is not solidified, preferably 10° C. The upper limit of normal temperature is for example 40° C. or less. By setting the temperature of the collection solvent 70 to 10° C. or more and 40° C. or less, as the vaporization of a flavor constituent from a collection solution is inhibited, volatile impurity components such as ammonium ion and pyridine can be efficiently removed from the collection solution. As the collection solvent 70, for example, glycerin, water or ethanol can be used. In order to prevent the revaporization of a flavor constituent captured by the collection solvent 70, any acid such as malic acid or citric acid may be added to the collection solvent 70. In order to raise capture efficiency for a flavor constituent, a component or a substance such as an aqueous solution of citric acid may be added to the collection solvent 70. That is, the collection solvent 70 may be constituted of several types of component or substance. In order to raise capture efficiency for a flavor constituent, the initial pH of the collection solvent 70 is preferably lower than the pH of the tobacco raw material 50 after an alkali treatment.

The pipe 22 takes a release component 61, which is released in the gas phase from the tobacco raw material 50 by heating the tobacco raw material 50, to the collection solvent 70. The release component 61 contains at least a nicotine component which is an index of a flavor constituent. Since the tobacco raw material 50 is subjected to an alkali treatment, the release component 61 contains ammonium ion in some cases depending on time elapsing from the beginning of the collection step of a flavor constituent (treatment time). The release component 61 contains TSNA in some cases depending on time elapsing from the beginning of the collection step (treatment time).

A release section 23 is provided on the tip of the pipe 22 and immersed in the collection solvent 70. The release section 23 has a plurality of openings 23A. The release component 61 taken by the pipe 22 is released in the collection solvent 70 from a plurality of openings 23A as a foam-like release component 62.

The pipe 24 takes a residual component 63 which has not been captured by the collection solvent 70 to the outside of the container 21.

Since the release component 62 is a component which is released in the gas phase by heating the tobacco raw material 50, there is a possibility that the temperature of the collection solvent 70 is raised by the release component 62. Therefore, the collection device 20 may have a function for cooling the collection solvent 70 to maintain the temperature of the collection solvent 70 to normal temperature.

The collection device 20 may have a raschig ring to increase the contact area of the release component 62 with the collection solvent 70.

(Application Example)

Figure 3:
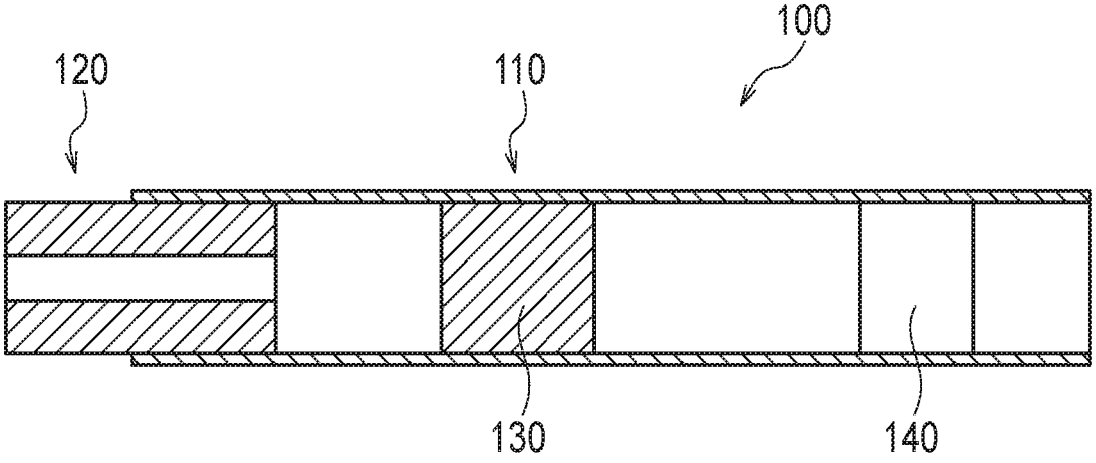
FIG. 3 is a diagram illustrating an example of the application of a flavor constituent.

An example of the application of a flavor constituent extracted from the tobacco raw material 50 will be described below. FIG. 3 is a diagram illustrating an example of the application of a flavor constituent. For example, a flavor constituent is provided for a constituent of a favorite item (e.g. a flavor source for a flavor inhaler).

As shown in FIG. 3, a flavor inhaler 100 has a holder 110, a carbon heat source 120, a flavor source 130 and a filter 140.

The holder 110 is for example a paper pipe with a tubular shape. The carbon heat source 120 generates heat to heat the flavor source 130. The flavor source 130 is a substance to generate a flavor and is an example of a base material for a flavor source for which alkaloid including nicotine is provided. The filter 140 inhibits the introduction of impurity substances to the mouthpiece side.

The flavor inhaler 100 is described herein as an example of the application of a flavor constituent, but the embodiments are not limited thereto. A flavor constituent may be applied to other inhalers, for example, an aerosol source for electronic cigarettes (what is called E-liquid). In addition, a flavor constituent may be provided for base materials for a flavor source such as gum, tablets, films and candy.

(Extraction Method)

Figure 4:
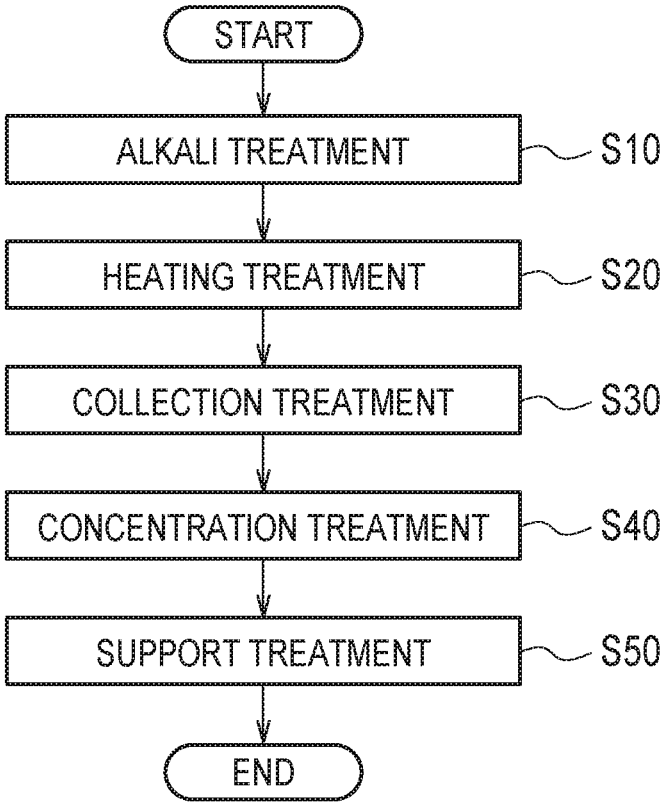
FIG. 4 is a flow diagram showing the extraction method in the first embodiment.

The extraction method involved in the first embodiment will be described below. FIG. 4 is a flow diagram showing the extraction method according to the first embodiment.

As shown in FIG. 4, an alkaline substance is provided for the tobacco raw material 50 using the alkali treatment device 10 described above in Step S10. As the alkaline substance, for example, a basic substance such as an aqueous solution of potassium carbonate can be used.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

The pH of the tobacco raw material 50 after an alkali treatment is preferably 8.0 or more as described above. Further preferably, the pH of the tobacco raw material 50 after an alkali treatment is preferably in a range from 8.9 to 9.7.

The tobacco raw material 50 may be subjected to a water addition treatment in Step S10. The amount of water in the tobacco raw material 50 before the water addition treatment is preferably 10 wt % or more, further preferably 30 wt % or more. The upper limit of the amount of water in the tobacco raw material 50 is not particularly limited, and for example preferably 50 wt % or less to efficiently heat the tobacco raw material 50.

The tobacco raw material 50 which has been subjected to an alkali treatment is heated in Step S20. In the heating treatment, for example, the tobacco raw material 50 can be heated with the container 11 with the tobacco raw material 50 put in the container 11 in the alkali treatment device 10. In such case, it is needless to say that the pipe 22 in the collection device 20 is attached to the container 11.

The heating temperature of the tobacco raw material 50 is in a range from 80° C. or more to less than 150° C. By setting the heating temperature of the tobacco raw material 50 to 80° C. or more, a time when a flavor constituent is sufficiently released from the tobacco raw material 50 can be earlier. By setting the heating temperature of the tobacco raw material 50 to less than 150° C., meanwhile, a time when TSNA is released from the tobacco raw material 50 can be delayed.

The tobacco raw material 50 can be subjected to a water addition treatment in Step S20. The amount of water in the tobacco raw material 50 after the water addition treatment is preferably 10% or more and 50% or less. In addition, water may be continuously added to the tobacco raw material 50 in Step S20. It is preferred that the amount of water added be adjusted so that the amount of water in the tobacco raw material 50 will be 10% or more and 50% or less.

It is also preferred that the tobacco raw material 50 be subjected to an aeration treatment in Step S20. Therefore, the amount of flavor constituent contained in the release component 61 which is released in the gas phase from the alkali-treated tobacco raw material 50 can be increased. In the aeration treatment, for example, saturated water vapor at 80° C. is brought into contact with the tobacco raw material 50. The aeration time in the aeration treatment varies depending on a device for treating the tobacco raw material 50 and the amount of tobacco raw material 50, and thus cannot be necessarily specified, and for example, the aeration time is within 300 minutes when the tobacco raw material 50 is 500 g. The gross aeration volume in the aeration treatment also varies depending on a device for treating the tobacco raw material 50 and the amount of tobacco raw material 50, and thus cannot be necessarily specified, and for example, the volume is about 10 L/g when the tobacco raw material 50 is 500 g.

Air used in the aeration treatment is not necessarily saturated water vapor. The amount of water in air used in the aeration treatment may be adjusted so that water contained in the tobacco raw material 50 to which the heating treatment and the aeration treatment have been applied is for example less than 50% without particularly requiring the humidification of the tobacco raw material 50. The gas used in the aeration treatment is not limited to air and may be inert gases such as nitrogen and argon.

In Step S30, a release component which is released in the gas phase in Step S20 is brought into contact with the collection solvent 70 at normal temperature until any time from when the first condition is satisfied to when the second condition is satisfied using the above-described collection device 20. It should be noted that Step S20 and Step S30 are shown as different treatments in FIG. 4 for the convenience of illustration, but Step S20 and Step S30 are treatments which are carried out in parallel. Being carried out in parallel means that the period to carry out Step S30 overlaps with the period to carry out Step S20, and it should be noted that Step S20 and Step S30 do not need to start and finish at the same time.

In Step S20 and Step S30, the pressure in the container 11 in the alkali treatment device 10 is not more than normal pressure. Specifically, the upper limit of the pressure in the container 11 in the alkali treatment device 10 is +0.1 MPa or less as gauge pressure. In addition, a reduced pressure atmosphere may be inside the container 11 in the alkali treatment device 10.

As the collection solvent 70, for example, glycerin, water or ethanol can be used as described above. The temperature of the collection solvent 70 is normal temperature as described above. The lower limit of normal temperature is for example a temperature at which the collection solvent 70 is not solidified, preferably 10° C. The upper limit of normal temperature is for example 40° C. or less.

The first condition is a condition that the remaining amount of flavor constituent (herein, a nicotine component) contained in the tobacco raw material decreases until reaching 1.7 wt % in the case where the weight of a tobacco raw material in the dry state is 100 wt %. Alternatively, the first condition is a condition that the residual rate of flavor constituent (herein, a nicotine component) contained in the tobacco raw material decreases until 40% in the case where the weight of a tobacco raw material is 100 wt %.

In the case where the weight of the tobacco raw material 50 in the dry state is 100 wt %, the second condition is a condition that the remaining amount of flavor constituent (herein, a nicotine component) contained in the tobacco raw material 50 decreases until reaching 0.3 wt %. Further preferably, the second condition is a condition that the remaining amount of flavor constituent (herein, a nicotine component) contained in the tobacco raw material 50 decreases until reaching 0.4 wt % in the case where the weight of the tobacco raw material 50 in the dry state is 100 wt %. Further preferably, the second condition is a condition that the remaining amount of flavor constituent (herein, a nicotine component) contained in the tobacco raw material 50 decreases until reaching 0.6 wt % in the case where the weight of the tobacco raw material 50 in the dry state is 100 wt %. Further preferably, the second condition is a condition that the remaining amount of flavor constituent (herein, a nicotine component) contained in the tobacco raw material 50 decreases until reaching 0.7 wt % in the case where the weight of the tobacco raw material 50 in the dry state is 100 wt %.

The profile of the remaining amount of flavor constituent (herein, a nicotine component) contained in the tobacco raw material 50 is measured in advance in the same conditions as in the actual treatments, and the remaining amount of flavor constituent is preferably replaced with treatment time. That is, the second condition is preferably replaced with treatment time. Therefore, it is not required to monitor the remaining amount of flavor constituent in real time and an increase in the amount of TSNA contained in a collection solution can be inhibited by simple control.

In Step S40, in order to raise the concentration of a flavor constituent contained in a collection solution, the collection solvent 70 which has captured the flavor constituent (i.e. collection solution) is subjected to a vacuum concentration treatment, a heating concentration treatment or a salting-out treatment.

Since the vacuum concentration treatment is carried out in a sealed space, contact with air is limited, and it is not required that the collection solvent 70 be raised to a high temperature, and thus there is a little concern about changes in components. Therefore, types of collection solvent which can be used are increased by using vacuum concentration.

In the heating concentration treatment, there is concern about liquid denaturation, for example, oxidation of a flavor constituent, but there is a possibility that an effect for increasing a flavor is obtained. However, compared to the vacuum concentration, types of collection solvent which can be used are decreased. There is for example a possibility that a collection solvent having an ester structure such as MCT (Medium Chain Triglyceride) cannot be used.

In the salting-out treatment, compared to the vacuum concentration treatment, the concentration of a flavor constituent can be increased; however, the flavor constituent is separated into the liquid solvent phase and water phase, and thus the yield rate of the flavor constituent is low. In addition, it is supposed that the coexistence of a hydrophobic substance (such as MCT) is essential, and thus there is a possibility that salting-out does not occur depending on the ratio between collection solvent, water and flavor constituent.

In Step S50, a flavor constituent captured by the collection solvent 70 is supported by a base material for a flavor source.

It should be noted that since a main object of the first embodiment is to extract a flavor constituent, the treatments of Step S40 and Step S50 are not essential.

(Action and Effect)

In the first embodiment, Step S30 for bringing a release component into contact with the collection solvent 70 is continued at least until the first condition is satisfied. Therefore, Step S30 is continued in a zone in which the decrease rate of the remaining amount of flavor constituent contained in a tobacco raw material (i.e. a rate at which a nicotine component is volatilized from the tobacco raw material 50) is not less than a predetermined rate, and thus the flavor constituent can be efficiently recovered. In the meantime, Step S30 for bringing a release component into contact with the collection solvent 70 is finished at least by the time when the second condition that the remaining amount of nicotine component contained in a tobacco raw material decreases until reaching 0.3 wt % is satisfied. Therefore, a situation in which although a rise in the recovery rate of flavor constituent (herein, a nicotine component) is not expected, Step S30 is continued is inhibited, and a flavor constituent can be efficiently extracted from a tobacco raw material.

As described above, a flavor constituent can be sufficiently extracted by simple treatments such as Step S20 and Step S30. That is, a flavor constituent can be extracted by a simple device.

In the first embodiment, Step S30 for bringing a release component into contact with the collection solvent 70 may be finished by the time when the second condition that the remaining amount of nicotine component contained in a tobacco raw material decreases until reaching 0.4 wt % is satisfied. By finishing S30 prior to the amount of TSNA released increases, an increase in the amount of TSNA contained in a collection solution is inhibited.

In the embodiment, non-volatile components contained in the tobacco raw material 50 do not move to a collection solvent, and only components volatilized at about 120° C. can be collected in the collection solvent, and thus it is effective that components collected by a collection solvent are used as an aerosol source for electronic cigarettes. Therefore, as an increase in volatile impurity components such as ammonium ion, acetaldehyde and pyridine is inhibited in electronic cigarettes, aerosol containing a tobacco flavor can be delivered to users, and further scorching of a heater to heat an aerosol source, and the like can be inhibited. The term "electronic cigarette" herein indicates a non-combustion type flavor inhaler or aerosol inhaler which comprises an electric heater to heat and atomize a liquid aerosol source and an aerosol source and is to deliver aerosol to users (e.g. an aerosol inhaler described in Japanese Patent No. 5196673, an aerosol electronic cigarette described in Japanese Patent No. 5385418, etc.).

Other Embodiments

The present invention is described by way of the embodiment described above. It should not be understood however that the present invention is limited to the description and figures forming parts of this disclosure. Various alternate embodiments, examples and operation techniques will be apparent to one skilled in the art by this disclosure.

For example, a collection solvent which contains a flavor constituent of the tobacco raw material 50 by contact with the flavor constituent released from the tobacco raw material 50 in Step S30 (i.e. collection solution) can be added to the tobacco raw material 50 from which the flavor constituent has been released in Step S20 (the residue of the tobacco raw material) (return treatment). By carrying out such return treatment, impurity components (such as ammonium ion and TSNA) can be further removed, and a tobacco raw material inhibiting the loss of a flavor constituent can be produced. In the return treatment, a collection solution to be added to the residue of a tobacco raw material may be neutralized. In the return treatment, after adding a collection solution to the residue of a tobacco raw material, the residue of the tobacco raw material containing a flavor constituent may be neutralized. It should be noted that after returning a collection solution to the residue of a tobacco raw material in the return treatment, the amount of flavor constituent (herein, a nicotine component) contained in the tobacco raw material is not more than the amount of flavor constituent (herein, a nicotine component) contained in the tobacco raw material before the flavor constituent is released.

Furthermore, before the above-described return treatment, the tobacco raw material 50 from which a flavor constituent has been released in Step S20 (the residue of the tobacco raw material) may be washed by a washing solvent. The washing solvent can include aqueous solvents, and specific examples thereof can be pure water and ultrapure water, and can include city water. Therefore, impurity substances remaining in the residue of the tobacco raw material are removed. Therefore, even in a case where the above-described return treatment is carried out, impurity components (such as ammonium ion and TSNA) can be further removed, and a tobacco raw material inhibiting the loss of a flavor constituent can be produced.

Experimental Results (First Experiment)

In the first experiment, samples (Sample A to Sample C) shown in FIG. 5 were prepared and the remaining amount of alkaloid (herein, a nicotine component) contained in a tobacco raw material in the dry state (hereinafter, nicotine concentration in tobacco raw material), the residual rate of alkaloid (herein, a nicotine component) contained in a tobacco raw material in the dry state (hereinafter, nicotine residual rate), the recovery rate of alkaloid (herein, a nicotine component) contained in a collection solution (hereinafter, nicotine recovery rate), and the concentration of TSNA contained in a collection solution (hereinafter, TSNA concentration in collection solution) were measured under the following conditions.

Figures 5, 6:
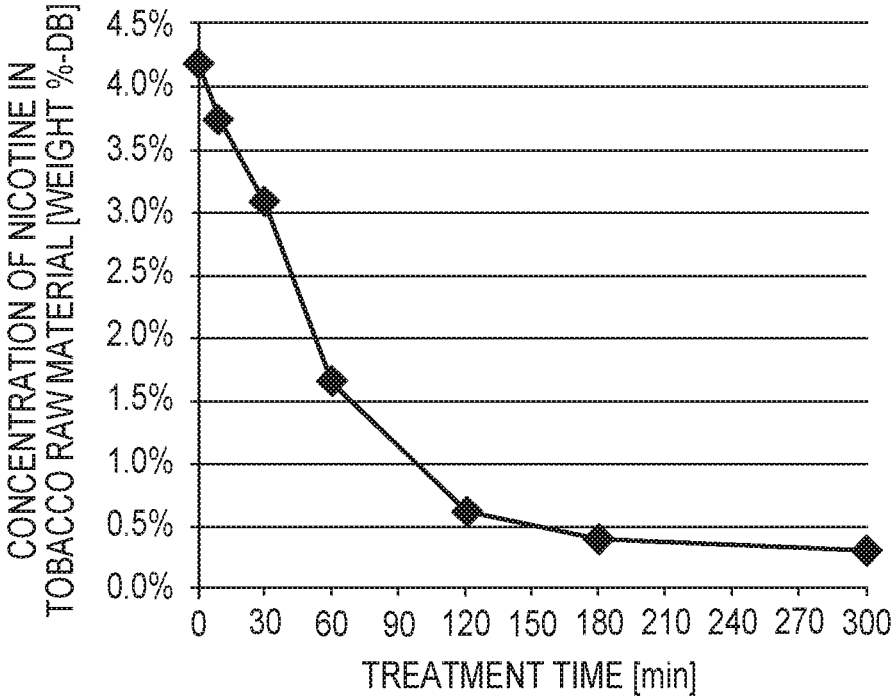
FIG. 5 is a diagram illustrating the first experiment.
FIG. 6 is a diagram illustrating the first experiment.
Figure 7:
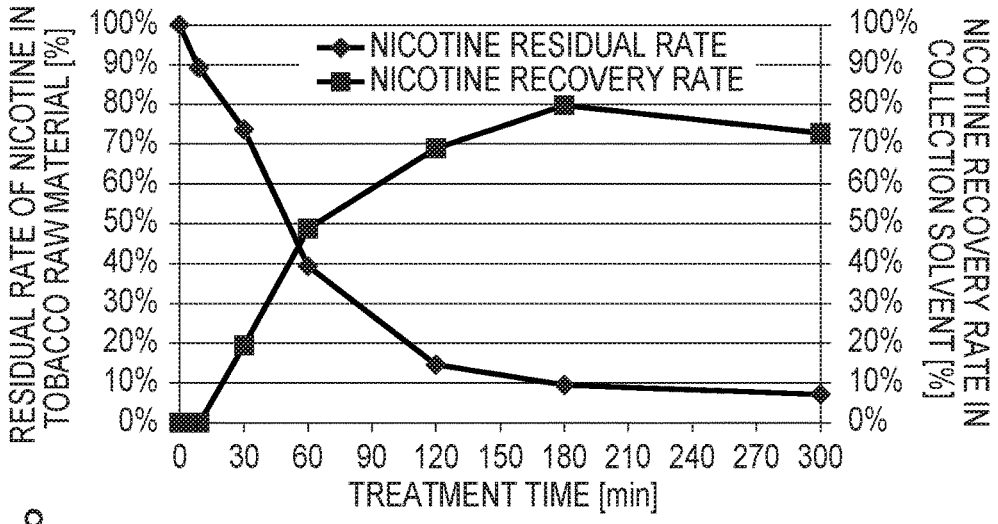
FIG. 7 is a diagram illustrating the first experiment.
Figure 8:
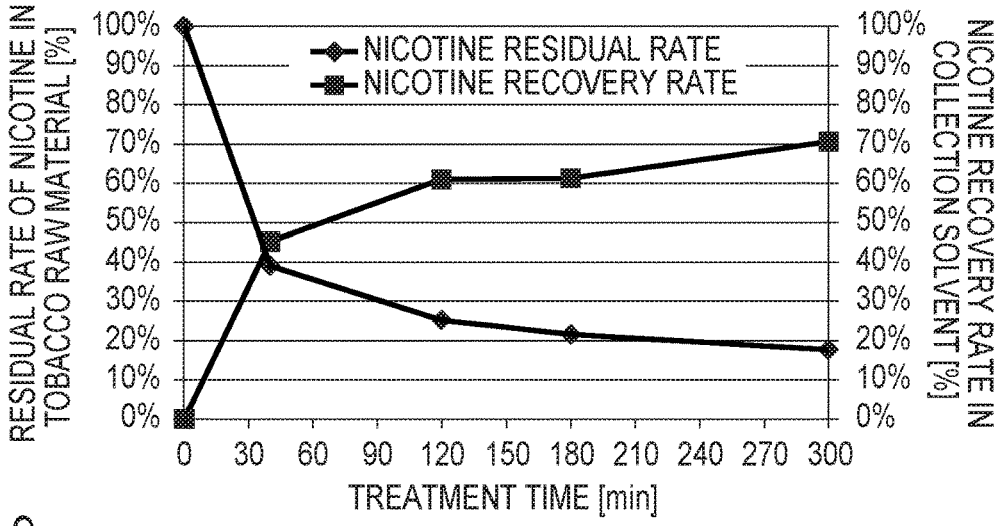
FIG. 8 is a diagram illustrating the first experiment.
Figure 9:
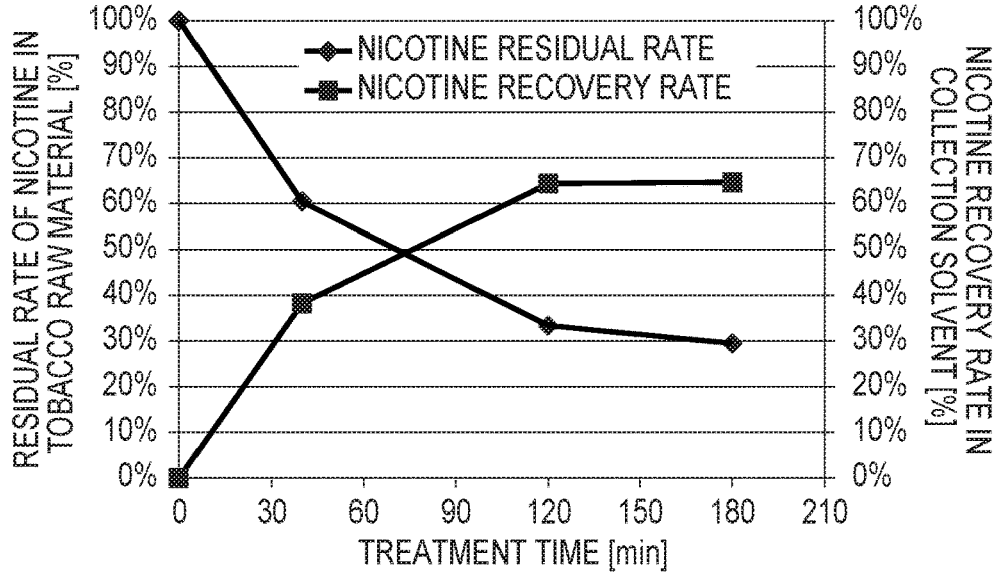
FIG. 9 is a diagram illustrating the first experiment.
Figure 10:
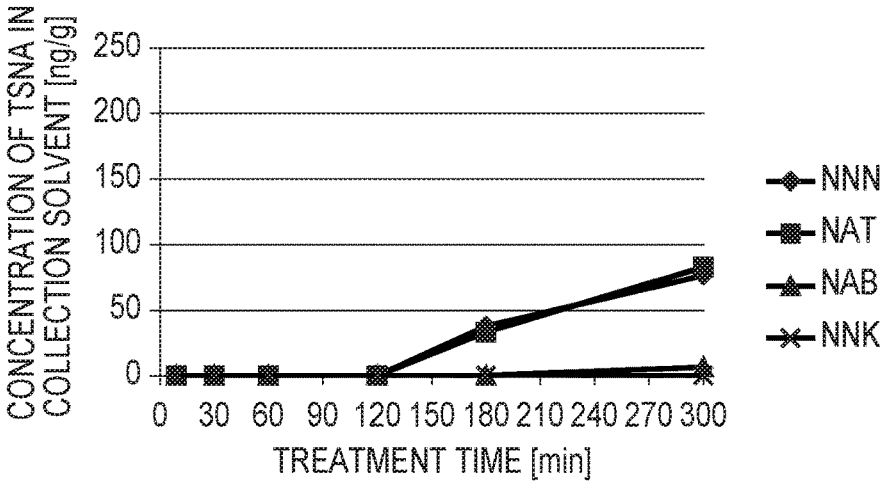
FIG. 10 is a diagram illustrating the first experiment.
Figure 11:
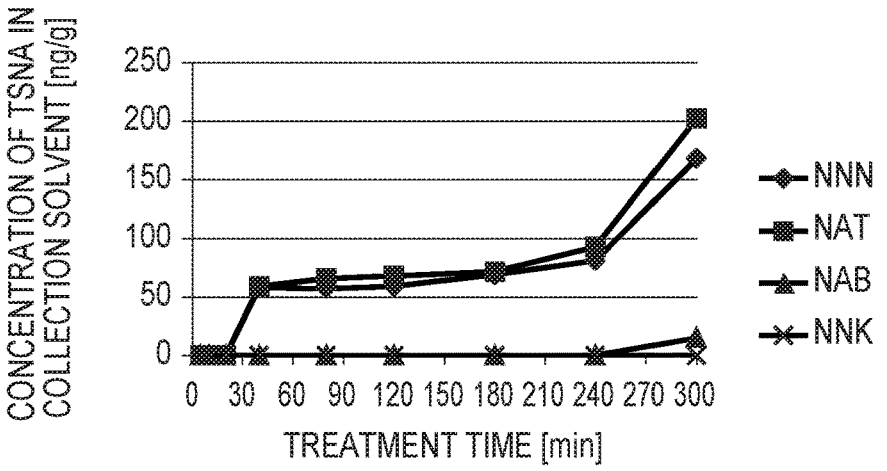
FIG. 11 is a diagram illustrating the first experiment.
Figure 12:
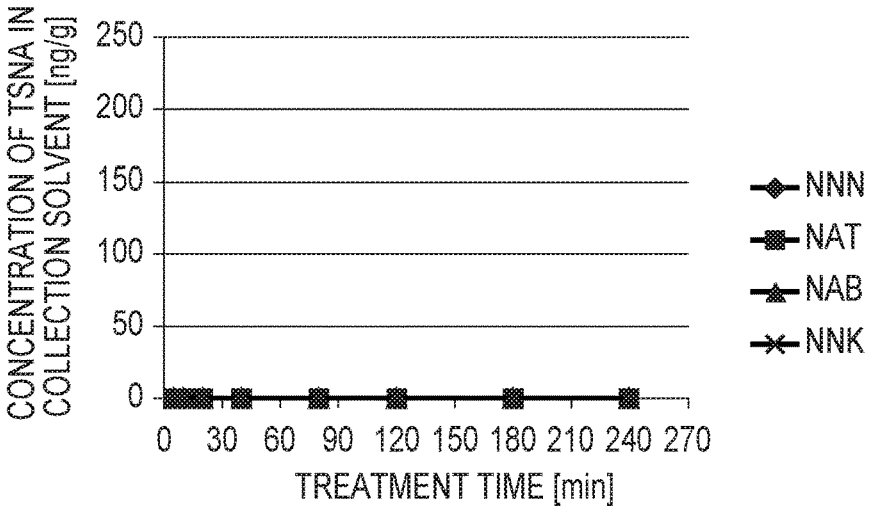
FIG. 12 is a diagram illustrating the first experiment.

The measurement results of the nicotine concentration in tobacco raw material of Sample A to Sample C are as shown in FIG. 6. The nicotine residual rate and the nicotine recovery rate of Sample A are as shown in FIG. 7, the nicotine residual rate and the nicotine recovery rate of Sample B are as shown in FIG. 8, and the nicotine residual rate and the nicotine recovery rate of Sample C are as shown in FIG. 9. The measurement results of the TSNA concentration in collection solution of Sample A are as shown in FIG. 10, the measurement results of the TSNA concentration in collection solution of Sample B are as shown in FIG. 11, and the measurement results of the TSNA concentration in collection solution of Sample C are as shown in FIG. 12. The nicotine concentration in tobacco raw material is represented by percent by weight in a case where the weight of a tobacco raw material in the dry state is 100 wt %. The nicotine residual rate is represented by the ratio to the initial weight of a nicotine component contained in a tobacco raw material in the dry state. The nicotine recovery rate is represented by the ratio to the initial weight of a nicotine component contained in a tobacco raw material in the dry state. The concentration of TSNA contained in a collection solution is represented by percent by weight in a case where the collection solution is 100 wt %. In FIG. 6 to FIG. 12, the treatment time is a time elapsing from the beginning of the heating treatment (S20) of a tobacco raw material. It can be thought that the treatment time is a time elapsing from the beginning of the collection treatment (S30) of a flavor constituent (hereinafter, a nicotine component).

About four types of TSNA, 4-(methylnitrosamino)-1-(3-pyridyl)-1-butanone (hereinafter, NNK), N'-nitrosonomicotine (hereinafter, NNN), N'-nitrosoanatabine (hereinafter, NAT) and N'-nitrosoanabasine (hereinafter, NAB), these concentrations were measured.

—Experimental Conditions—

Amount of tobacco raw material: 500 g

Heating temperature of tobacco raw material: 120° C.

pH of tobacco raw material after alkali treatment: 9.6

Initial amount of water in tobacco raw material after alkali treatment: 39%±2%

Type of collection solvent: glycerin

Temperature of collection solvent: 20° C.

Amount of collection solvent: 60 g

Aeration flow during bubbling treatment (aeration treatment and collection treatment): 15 L/min The gas used in the bubbling treatment (aeration treatment) is the atmosphere at about 20° C. and about 60%-RH.

First, in Sample A, it was verified that the decrease rate of the remaining amount of nicotine component contained in a tobacco raw material (i.e. a rate at which the nicotine component is volatilized from the tobacco raw material) was not less than a predetermined rate until the treatment time reached a time when the nicotine concentration in tobacco raw material reaches 1.7 wt % (60 minutes in the present experimental result) as shown in FIG. 6 and a rise in the recovery rate of nicotine component could be expected.

Such experimental results verified that preferably the heating treatment (S20) and the collection treatment (S30) were continued until the time when the nicotine concentration in tobacco raw material reaches 1.7 wt % in Sample A from the viewpoint of the efficient recovery of the nicotine component. That is, it was verified that preferably the first condition was a condition that the nicotine concentration in tobacco raw material decreases until 1.7 wt %.

Second, in Sample A to Sample C, it was verified that the decrease rate of the remaining amount of nicotine component contained in a tobacco raw material (a rate at which the nicotine component is volatilized from the tobacco raw material) was not less than a predetermined rate until the treatment time reached a time when the nicotine residual rate reaches 40% as shown in FIG. 7 to FIG. 9, and a rise in the recovery rate of nicotine component could be expected.

Such experimental results verified that preferably the heating treatment (S20) and the collection treatment (S30) were continued until the time when the nicotine residual rate reaches 40% in Sample A to Sample C from the viewpoint of the efficient recovery of the nicotine component. That is, it was verified that preferably the first condition was a condition that the nicotine residual rate decreases until reaching 40%.

Third, in Sample A, the nicotine residual rate intermittently decreases in the profile of the nicotine concentration in tobacco raw material as shown in FIG. 6. It was verified that NNK did not change but NNN, NAT and NAB increased after a lapse of a fixed period in the profile of the TSNA concentration in collection solution as shown in FIG. 10.

Specifically, it was verified that when the treatment time reached a time when the nicotine concentration in tobacco raw material reaches 0.3 wt % (300 minutes in present experimental result) as shown in FIG. 6, the decrease rate of the remaining amount of nicotine component contained in the tobacco raw material (i.e. a rate at which the nicotine component is volatilized from the tobacco raw material) declined, and a rise in the recovery rate of nicotine component could not be expected as shown in FIG. 7. It was also verified that when the treatment time went through a time when the nicotine concentration in tobacco raw material reaches 0.4 wt % (180 minutes in the present experimental result) as shown in FIG. 6, NAB in a collection solution gradually increased as shown in FIG. 10. It was further verified that when the treatment time went through a time when the nicotine concentration in tobacco raw material reaches 0.6 wt % (120 minutes in the present experimental result) as shown in FIG. 6, NNN and NAT in a collection solution considerably increased as shown in FIG. 10.

Fourth, in Sample B, the remaining amount of nicotine component contained in a tobacco raw material intermittently decreases in the profile of the nicotine concentration in tobacco raw material as shown in FIG. 6. It was verified that NNK did not change but NNN, NAT and NAB increased after a lapse of a fixed period in the profile of TSNA concentration in collection solution as shown in FIG. 11.

Specifically, it was verified that when the treatment time reached a time when the nicotine concentration in tobacco raw material reaches 0.3 wt % (300 minutes in the present experimental result) as shown in FIG. 6, the decrease rate of the remaining amount of nicotine component contained in a tobacco raw material (i.e. a rate at which the nicotine component is volatilized from the tobacco raw material) declined, and a rise in the recovery rate of nicotine component could not be expected as shown in FIG. 8. It was also verified that when the treatment time went through a time (240 minutes in the present experimental result) later than a time when the nicotine concentration in tobacco raw material reaches 0.4 wt % (180 minutes in the present experimental result) as shown in FIG. 6, NAB in a collection solution gradually increased as shown in FIG. 11. It was further verified that when the treatment time went through a time when the nicotine concentration in tobacco raw material reaches 0.7 wt % (40 minutes in the present experimental result) as shown in FIG. 6, NNN and NAT in a collection solution started to increase as shown in FIG. 11.

Fifth, in Sample C, the remaining amount of nicotine component contained in a tobacco raw material intermittently decreases in the profile of the nicotine concentration in tobacco raw material as shown in FIG. 6. It was verified that NNN, NAB, NNK and NAB hardly increased in the profile of the TSNA concentration in collection solution as shown in FIG. 12.

Specifically, it was verified that when the treatment time reached a time when the nicotine concentration in tobacco raw material reaches about 1.0 wt % (180 minutes in the present experimental result) as shown in FIG. 6, the decrease rate of the remaining amount of nicotine component contained in the tobacco raw material (i.e. a rate at which the nicotine component is volatilized from the tobacco raw material) declined, but the recovery rate of nicotine component did not decline as shown in FIG. 9. It was also verified that as described above, without depending on treatment time, NNN, NAB, NNK and NAB hardly increased as shown in FIG. 12.

First, such experimental results verified that preferably the heating treatment (S20) and the collection treatment (S30) were finished prior to the time when the nicotine concentration in tobacco raw material reaches 0.3 wt % in both Sample A and Sample B. That is, it was verified that preferably the second condition was a condition that the nicotine concentration in tobacco raw material decreases until reaching 0.3 wt %.

It is supposed that in Sample C, the time required until the nicotine concentration in tobacco raw material reaches 0.3 wt % is longer than that of Samples A and B; however, it is verified that the decrease rate of the remaining amount of nicotine component contained in the tobacco raw material (i.e. a rate at which the nicotine component is volatilized from the tobacco raw material) declines at least at the time when the nicotine concentration in tobacco raw material reaches about 1.0 wt % (180 minutes in the present experimental result), and therefore it is thought that the same second condition as for Samples A and B can be applied to Sample C. In Sample C, however, the second condition may be decided for example by the upper limit of treatment time (e.g. 300 minutes) due to production reasons.

Second, it was verified that further preferably the heating treatment (S20) and the collection treatment (S30) were finished before the time when the nicotine concentration in tobacco raw material reaches 0.4 wt % in both Sample A and Sample B. That is, it was verified that further preferably the second condition was a condition that the nicotine concentration in tobacco raw material decreases until reaching 0.4 wt %.

Third, it was verified that further preferably the heating treatment (S20) and the collection treatment (S30) were finished before the time when the nicotine concentration in tobacco raw material reaches 0.6 wt % in Sample A. That is, it was verified that further preferably the second condition was a condition that the nicotine concentration in tobacco raw material decreases until reaching 0.6 wt %.

Fourth, it was verified that further preferably the heating treatment (S20) and the collection treatment (S30) were finished before the time when the nicotine concentration in tobacco raw material reaches 0.7 wt % in Sample B. That is, it was verified that further preferably the second condition was a condition that the nicotine concentration in tobacco raw material decreases until reaching 0.7 wt %. It should be noted that by setting such second condition, NNN and NAT in a collection solution do not increase also in Sample A.

It is verified that NNN, NAB, NNK and NAB hardly increase at least at a time when the nicotine concentration in tobacco raw material reaches about 1.0 wt % (180 minutes in the present experimental result) in Sample C, and therefore it is thought that the same second condition as for Samples A and B can be applied to Sample C. In Sample C, however, the second condition may be decided for example by the upper limit of treatment time (e.g. 300 minutes) due to production reasons.

Second Embodiment

Figure 13:
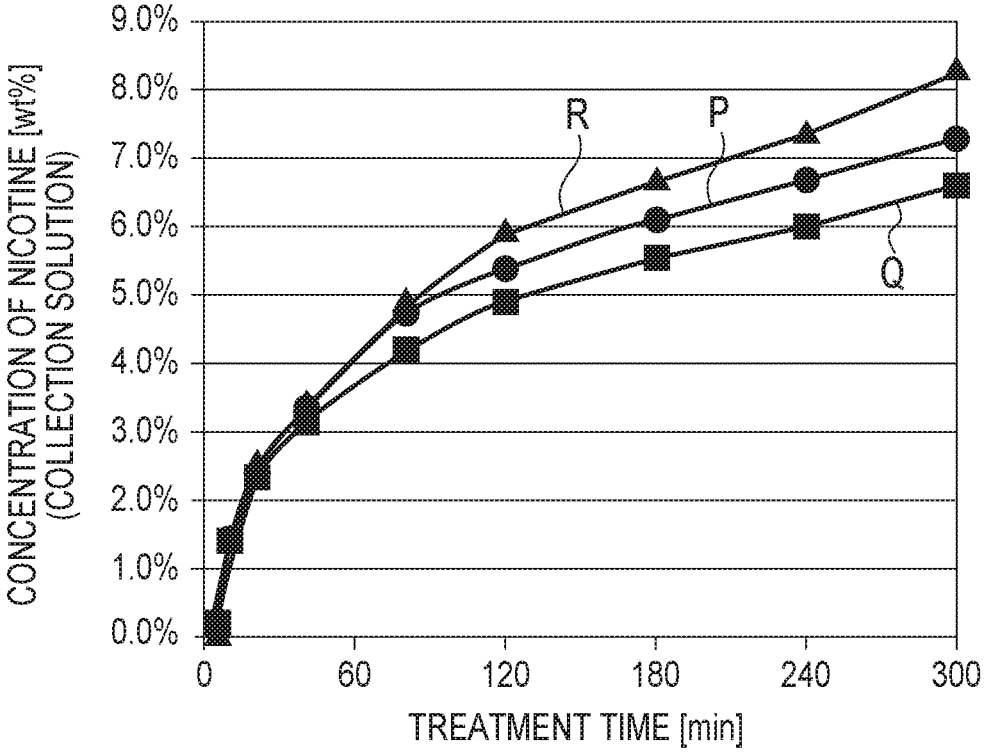
FIG. 13 is a diagram illustrating the second experiment.

In the second embodiment, Sample P to Sample Q were prepared, and the concentration of alkaloid (herein, a nicotine component) contained in a collection solution were measured under the following conditions. Sample P is a sample using glycerin as a collection solvent. Sample Q is a sample using water as a collection solvent. Sample R is a sample using ethanol as a collection solvent. The measurement results of the concentration of a nicotine component contained in a collection solution are as shown in FIG. 13. In FIG. 13, the treatment time is a time elapsing from the beginning of the heating treatment (S20) of a tobacco raw material. It can be thought that the treatment time is a time elapsing from the beginning of the collection treatment (S30) of a nicotine component.

—Experimental Conditions—

Amount of tobacco raw material: 500 g
Type of tobacco raw material; burley type
Heating temperature of tobacco raw material: 120° C.
pH of tobacco raw material after alkali treatment: 9.6
Temperature of collection solvent: 20° C.
Amount of collection solvent: 60 g
Aeration flow during bubbling treatment (aeration treatment and collection treatment): 15 L/min The gas used in the bubbling treatment (aeration treatment) is the atmosphere at about 20° C. and about 60%-RH.

As shown in FIG. 13, when glycerin, water or ethanol was used as a collection solvent, a significant different between the concentrations of nicotine component contained in a collection solution was not shown.

Such experimental results verified that glycerin, water or ethanol could be used as a collection solvent.

(Third Experiment)

Figure 14:
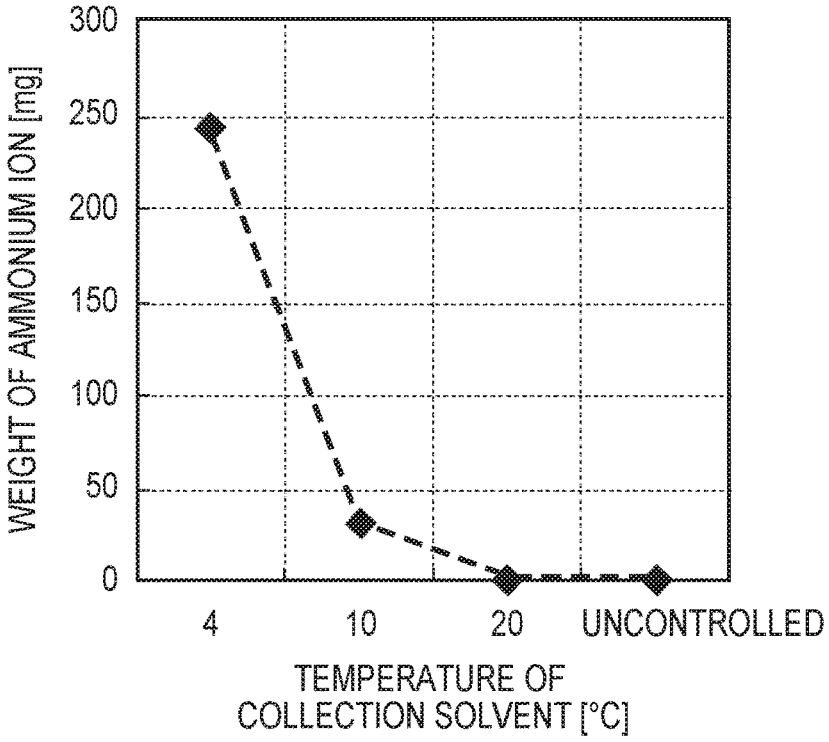
FIG. 14 is a diagram illustrating the third experiment.

In the third experiment, the weight of ammonium ion and pyridine contained in a collection solution was measured by changing the temperature of a collection solvent under the following conditions. The weight of ammonium ion contained in a collection solution is as shown in FIG. 14. The weight of pyridine contained in a collection solution is as shown in FIG. 15.

—Experimental Conditions—

Amount of tobacco raw material: 500 g
Type of tobacco raw material; burley type
Heating temperature of tobacco raw material: 120° C.
pH of tobacco raw material after alkali treatment: 9.6
Type of collection solvent: glycerin
Amount of collection solvent: 60 g First, it was verified that when the temperature of a collection solvent was 10° C. or more, ammonium ion could be efficiently removed as shown in FIG. 14. In the meantime, it was verified that even when the temperature of a collection solvent was not controlled, ammonium ion could be efficiently removed. The vaporization of alkaloid (herein, a nicotine component) from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, ammonium ion can be efficiently removed from the collection solution.

Figure 15:
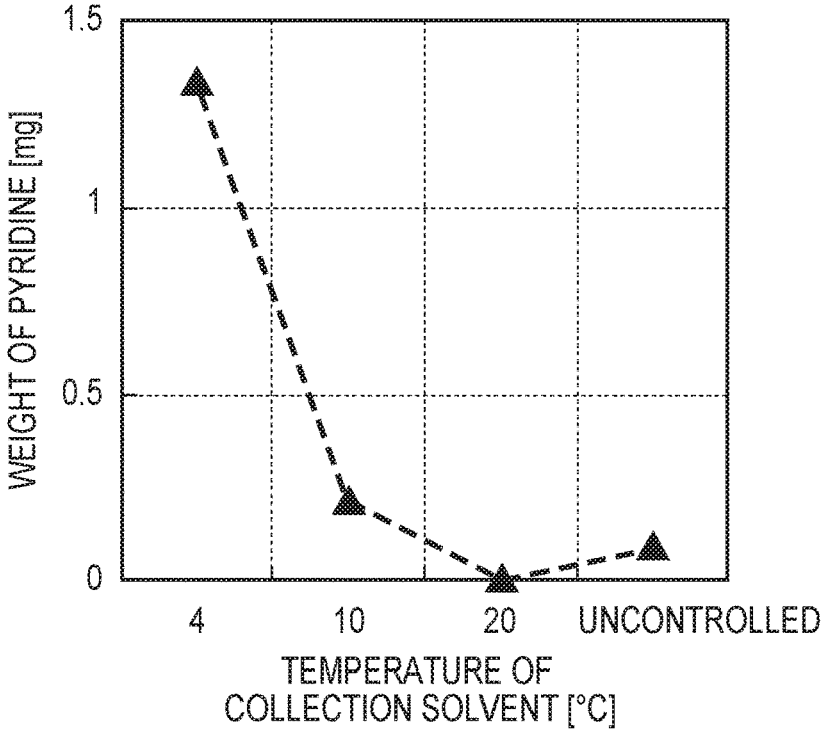
FIG. 15 is a diagram illustrating the third experiment.

Second, it was verified that in the case where the temperature of a collection solvent was 10° C. or more, pyridine could be efficiently removed as shown in FIG. 15. In the meantime, it was verified that even when the temperature of a collection solvent was not controlled, pyridine could be efficiently removed. The vaporization of a nicotine component from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, pyridine can be efficiently removed from the collection solution.

The temperature of a collection solvent is the preset temperature of the chiller (a constant-temperature bath) controlling the temperature of a container containing the collection solvent. It should be noted that in the present experimental conditions, the temperature of a collection solvent is settled about 60 minutes after the container is set in the chiller and the temperature control starts.

(Method for Measuring $NH_4^+$ Contained in Collection Solution)

A collection solution was collected in an amount of 50 μL, and diluted by adding 950 μL of a 0.05 N aqueous solution of dilute sulfuric acid, and the diluted solution was analyzed by ion chromatography to quantitate ammonium ion contained in the collection solution.

(Method for Measuring Nicotine Component Contained in Tobacco Raw Material)

The measurement was carried out in a method in accordance with the German Institute for Standardization (DIN) 10373. That is, a tobacco raw material was collected in an amount of 250 mg, and 7.5 mL of a 11% aqueous solution of sodium hydroxide and 10 mL of hexane were added thereto, and shaking extraction was carried out for 60 minutes. After the extraction, the hexane phase, supernatant, was used for a gas chromatograph mass spectrometer (GC/MS) to quantitate the weight of nicotine contained in the tobacco raw material.

(Method for Measuring Amount of Water Contained in Tobacco Raw Material)

A tobacco raw material was collected in an amount of 250 mg, and 10 mL of ethanol was added thereto, and shaking extraction was carried out for 60 minutes. After the extraction, the extract liquid was filtered with a 0.45 μm membrane filter, and used for a gas chromatograph with thermal conductivity detector (GC/TCD) to quantitate the amount of water contained in the tobacco raw material.

The weight of the tobacco raw material in the dry state is calculated by subtracting the above-described amount of water from the gross weight of the tobacco raw material.

(Method for Measuring TSNA Contained in Collection Solution)

A collection solution was collected in an amount of 0.5 mL, and diluted by adding 9.5 mL of a 0.1 M aqueous solution of ammonium acetate, and the diluted solution was analyzed by a high performance liquid chromatograph-mass spectrometer (LC-MS/MS) to quantitate TSNA contained in the collection solution.

(GC Analysis Conditions)

The conditions of GC analysis used to measure the amounts of nicotine component and water contained in a tobacco raw material are as shown in Table given below.

TABLE 1

| | Nicotine | Moisture |
|---|---|---|
| Model number of device (Manufacturer) | Agilent 6890GC&5975MSD (Agilent technologies) | HP 6890 (Hewlett Packard) |
| GC column | DB-1ms | DB-WAX |

(Method for Measuring Pyridine Contained in Collection Solution)

A collection solution was collected in an amount of 1 mL, and diluted by adding 19 mL of methanol, and the diluted solution was used for a gas chromatograph mass spectrometer to quantitate the amount of pyridine contained in the collection solution.

The entire contents of Japanese patent application No. 2014-035438 (filed on Feb. 26, 2014) are incorporated herein by reference.

INDUSTRIAL APPLICABILITY

According to the embodiments, there can be provided an extraction method for extracting a flavor constituent (e.g. alkaloid including a nicotine component) using a simple device and a producing method of a composition of a favorite item.

The invention claimed is:

1. An extraction method for extracting a flavor constituent from a tobacco raw material, comprising:

a step A for releasing a release component in a gas phase by heating a tobacco raw material, which has been subjected to an alkali treatment, at a pressure of +0.1 MPa or less as gauge pressure; and a step B for bringing the release component released in the gas phase in the step A into contact with a collection solvent at normal temperature until any time from when a first condition is satisfied to when a second condition is satisfied, wherein the first condition is a condition that a remaining amount of nicotine component which is an index of the flavor constituent contained in the tobacco raw material decreases until reaching 1.7 wt % based on 100 wt % of the tobacco raw material in a dry state, or is a condition that a residual rate of the nicotine component decreases until 40% based on 100 wt % of the tobacco raw material in the dry state, and the second condition is a condition that the remaining amount of the nicotine component contained in the tobacco raw material decreases until reaching 0.3 wt % based on 100 wt % of the tobacco raw material in the dry state.

2. The extraction method according to claim 1, wherein the tobacco raw material is subjected to a water addition treatment in the step A.

3. The extraction method according to claim 1, wherein the temperature of the collection solvent is 10° C. or more and 40° C. or less.

4. The extraction method according to claim 1, further comprising the step of applying an alkali substance to the tobacco raw material as the alkali treatment prior to the step A.

5. A manufacturing method of a composition of a favorite item, comprising:

a step A for releasing a release component in a gas phase by heating a tobacco raw material, which has been subjected to an alkali treatment, at a pressure of +0.1 MPa or less as gauge pressure;

a step B for bringing the release component released in the gas phase in the step A into contact with a collection solvent at normal temperature until any time from when a first condition is satisfied to when a second condition is satisfied; and a step C for adding a collection solution to the composition, the collection solution configured by the collection solvent comprising the release component, wherein the first condition is a condition that a remaining amount of nicotine component which is an index of a flavor constituent contained in the tobacco raw material decreases until reaching 1.7 wt % based on 100 wt % of the tobacco raw material in a dry state, or is a condition that the residual rate of the nicotine component decreases until 40% based on 100 wt % of the tobacco raw material in the dry state, and the second condition is a condition that the remaining amount of the nicotine component contained in the tobacco raw material decreases until reaching 0.3 wt % based on 100 wt % of the tobacco raw material in the dry state.

6. The manufacturing method according to claim 5, further comprising the step of applying an alkali substance to the tobacco raw material as the alkali treatment prior to the step A.

* * * * *